US012264033B2

(12) United States Patent
Bahmer et al.

(10) Patent No.: US 12,264,033 B2
(45) Date of Patent: Apr. 1, 2025

(54) FOLDING MACHINE COMPRISING A BLADE FOLDER, AND METHOD FOR FOLDING FOLDED PRODUCTS BY MEANS OF A BLADE FOLDER

(71) Applicant: H+H GMBH & CO. KG, Bielefeld (DE)

(72) Inventors: Frank Bahmer, Kleinwallstadt (DE); Witali Richert, Bielefeld (DE)

(73) Assignee: H+H GMBH & CO. KG, Bielefeld (DE)

( * ) Notice: Subject to any disclaimer, the term of this patent is extended or adjusted under 35 U.S.C. 154(b) by 195 days.

(21) Appl. No.: 18/015,761

(22) PCT Filed: Jun. 22, 2021

(86) PCT No.: PCT/EP2021/067017
§ 371 (c)(1),
(2) Date: Jan. 12, 2023

(87) PCT Pub. No.: WO2022/012881
PCT Pub. Date: Jan. 20, 2022

(65) Prior Publication Data

US 2023/0219781 A1 Jul. 13, 2023

(30) Foreign Application Priority Data

Jul. 13, 2020 (EP) ..... 20185547

(51) Int. Cl.
*B65H 45/18* (2006.01)
*B65H 29/12* (2006.01)
*B65H 45/14* (2006.01)

(52) U.S. Cl.
CPC ..... *B65H 45/18* (2013.01); *B65H 29/12* (2013.01); *B65H 45/147* (2013.01); *B65H 2701/1932* (2013.01)

(58) Field of Classification Search
CPC ..... B65H 2701/1932; B65H 29/12; B65H 45/142; B65H 45/147; B65H 45/18; B65H 37/02; B65H 37/04; B65H 37/06
See application file for complete search history.

(56) References Cited

U.S. PATENT DOCUMENTS 4,264,066 A 4/1981 Meenen
2014/0336031 A1* 11/2014 Suzuki ..... B65H 45/04 493/442

(Continued)

FOREIGN PATENT DOCUMENTS

CH 711243 A1 * 12/2016 ..... B41F 13/64
CN 207329941 U 5/2018

(Continued)

OTHER PUBLICATIONS

Machine translation of CH 711243 A1 (Year: 2016).*

(Continued)

*Primary Examiner* — Thomas M Wittenschlaeger
*Assistant Examiner* — Himchan Song
(74) *Attorney, Agent, or Firm* — LUCAS & MERCANTI, LLP

(57) ABSTRACT

A folding machine comprises a blade folding unit having a first and a second folding roller, the folding roller axes thereof defining a folding roller plane, and having a folding blade which is oriented and is movable in a folding blade plane which is oriented perpendicularly to the folding roller plane and intersects the folding roller plane in an intersection line. The folding blade is arranged in a retracted position in or below a horizontal plane which comprises the intersection line.

12 Claims, 8 Drawing Sheets

(56) References Cited

U.S. PATENT DOCUMENTS

| | | | | |
|---|---|---|---|---|
| 2015/0183611 | A1* | 7/2015 | Awano | B65H 45/16 493/411 |
| 2018/0079616 | A1* | 3/2018 | Nakano | B65H 37/04 |
| 2022/0192892 | A1* | 6/2022 | Xu | B65H 45/18 |
| 2023/0319202 | A1* | 10/2023 | Matsumoto | H04N 1/00639 270/58.08 |
| 2024/0182257 | A1* | 6/2024 | Yanase | B65H 31/26 |

FOREIGN PATENT DOCUMENTS

| | | | | |
|---|---|---|---|---|
| DE | 1286053 | B | 1/1969 | |
| DE | 3147064 | A1 | 6/1983 | |
| JP | 2007237562 | A * | 9/2007 | B65H 45/18 |

OTHER PUBLICATIONS

Machine translation of JP 2007237562 A (Year: 2007).*
International Search Report Dated Oct. 4, 2021, 2 Pages.
Office action of parallel European patent application issued Jan. 5, 2024, 6 pages.

* cited by examiner

V
H
33
16
16a
10a
10
18
20
12
12a
14

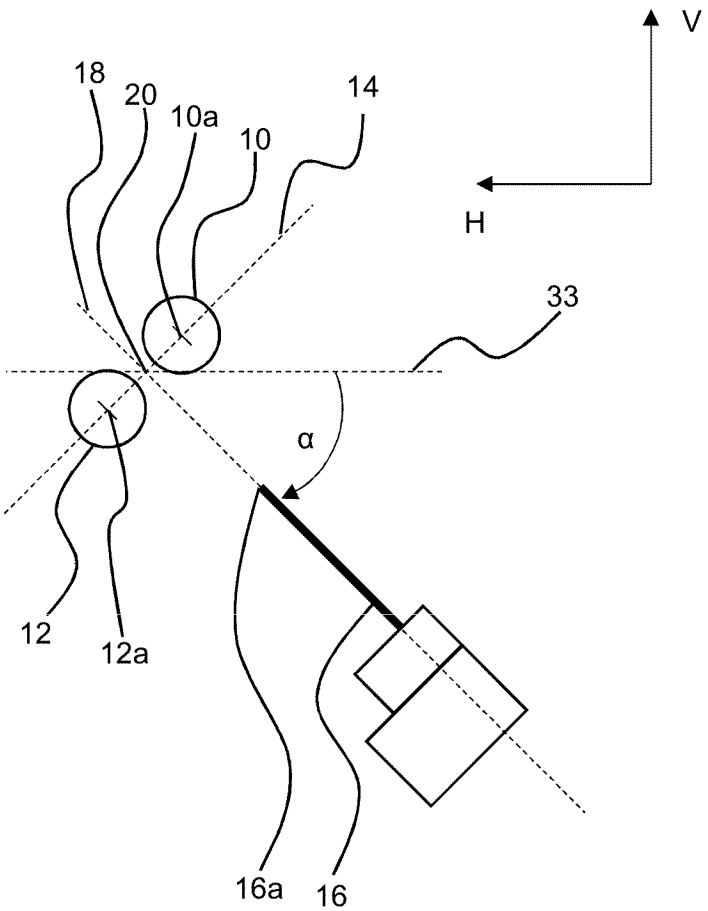
Fig. 3
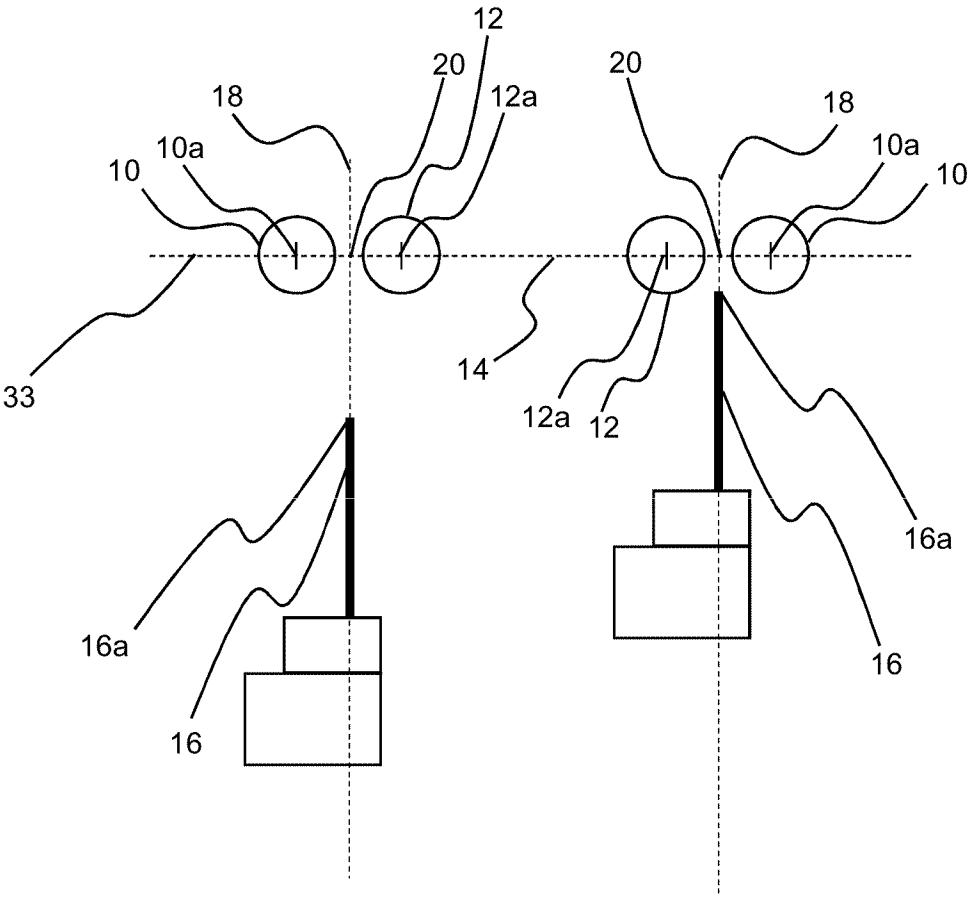
Fig. 2c
Fig. 2b

FOLDING MACHINE COMPRISING A BLADE FOLDER, AND METHOD FOR FOLDING FOLDED PRODUCTS BY MEANS OF A BLADE FOLDER

BACKGROUND OF THE INVENTION

The present invention relates to a folding machine comprising a blade folding unit and a method for folding products by means of a blade folding unit.

Folding machines for producing folded products generally comprise a plurality of different folding units. In this case, a differentiation is generally made between buckle folding units and blade folding units. In order to obtain a product which is folded as desired and which has different folding directions, it is generally necessary to combine buckle folding units and blade folding units. For example, a multi-part buckle folding machine initially generates a plurality of parallel folds in the foldable product. The cross-fold is than generally generated by a further buckle folding unit, and at least one blade folding unit may follow said further buckle folding unit. Buckle folding units, however, are generally expensive to purchase and require relatively long installation times and a great deal of experience in the set-up, which cannot be easily automated. Known blade folding units in turn permit the action of the folding blade only on the upper face of the foldable product, so that their field of use is limited, and the blade folding units have to be combined with buckle folding units in the cross-fold region in order to increase the flexibility of the folding machine or in order to increase the variety of folded products.

SUMMARY OF THE INVENTION

It is an object of the present invention to provide a folding machine and a method for folding products which permit a high degree of flexibility and variety in the design of the folded products and at the same time a reduction in the costs and the required installation times.

According to an aspect of the invention, a folding machine comprises a first blade folding unit comprising a first and a second folding roller, wherein the first folding roller has a first folding roller axis and the second folding roller has a second folding roller axis which is arranged spaced apart and parallel to the first folding roller axis, so that the first and the secand folding roller axes define a first folding roller plane. The first blade folding unit also comprises a first folding blade which is oriented and is movable in a first folding blade plane, wherein the first folding blade plane is oriented perpendicularly to the first folding roller plane and intersects the first folding roller plane in a first intersection line. The first folding blade is movable between a retracted position and an extended position, wherein the first folding blade is arranged in the extended position closer to the first folding roller plane than in the retracted position. The first folding blade is arranged in the retracted position in or below a horizontal plane which comprises the first intersection line. The two folding rollers are arranged one behind the other relative to an inlet direction of the foldable product into the first blade folding unit.

In this manner, a folding machine is provided with a blade folding unit in which the folding blade acts on a lower face of the foldable product, without having to rotate a product to be folded in a complex manner in advance, while a folding blade of hitherto known blade folding units acts on the upper face of the foldable product. Thus, the foldable products are folded by means of the folding machine according to this aspect of the invention in the opposing direction in comparison with hitherto known blade folding units, whereby the flexibility in the configuration of folded products by blade folding units is increased. Without sacrificing flexibility and product variety, a buckle folding unit can be dispensed with in the cross-fold region, whereby costs are saved and installation times reduced.

A foldable product can be a flat medium in this case, in particular a sheet of paper, cardboard or a similar material. The foldable product can correspond to a flat medium which is not yet folded, for example a sheet to be folded, or an intermediate product, such as for example a sheet which has already been folded once or repeatedly. In the first case, therefore, the first blade folding unit generates a first fold. In the second case, the first blade folding unit generates an additional fold to the one or more already existing folds, preferably in a direction perpendicular to the first fold.

Generally, the folding machine according to this aspect of the invention may be used as a paper folding machine, in particular when processing thin printing paper. The folded end product can be an outsert, for example.

The folding machine according to this aspect of the invention may process individual sheets.

The first and the second folding roller axes are located in the first folding roller plane.

The first folding blade plane is oriented perpendicularly to the first folding roller plane and intersects the first folding roller plane in the first intersection line. The first folding blade is arranged and oriented in the first folding blade plane and is movable therein between the retracted position and the extended position.

The first folding blade has a front edge which runs in a longitudinal direction of the first folding blade. The longitudinal direction of the first folding blade is preferably oriented parallel to the first and to the second folding roller axis. The front edge is located in the folding blade plane.

The folding blade is clamped at an end portion of the first folding blade which opposes the front edge. Preferably, the first blade folding unit comprises a drive device for moving the first folding blade between the retracted position and the extended position in the folding blade plane. The drive device thus comprises a clamping device for clamping the end portion of the first folding blade.

In order to permit the first folding blade to act on the lower face of a foldable product, the first folding blade is arranged in the retracted position in or below the horizontal plane which comprises the first intersection line. The first intersection line extends horizontally and is oriented or arranged in the horizontal plane.

In a preferred embodiment, the first folding blade is arranged in the retracted position below and perpendicularly to the horizontal plane which comprises the first intersection line. In this embodiment, the first folding roller plane is oriented horizontally and the first folding blade plane is oriented perpendicularly to the horizontal plane which comprises the first intersection line. In this embodiment, the first folding roller plane is located in the horizontal plane which comprises the first intersection line, and the first folding blade is arranged below the first folding roller plane.

In an alternative embodiment, the first folding blade is arranged parallel to and in the horizontal plane which comprises the first intersection line. The first folding blade plane is thus located in the horizontal plane, i.e. is itself a horizontal plane. In this embodiment, the first folding roller plane is oriented vertically and the first folding blade plane is oriented parallel to and in the horizontal plane which comprises the first intersection line.

In a further alternative embodiment, the first folding blade plane is oriented in an acute angle to the horizontal plane which comprises the first intersection line and the first folding blade is arranged in the retracted position below the horizontal plane.

A first angle between the horizontal plane and the first folding blade plane is defined on the side of the first folding blade plane on which foldable products are fed into a folding region between the first and the second folding roller and the first folding blade. Additionally, the first angle below the horizontal plane is defined between the horizontal plane and the first folding blade plane.

If the first folding blade is arranged perpendicularly to the horizontal plane, which comprises the first intersection line, the first angle is 90°.

If the first folding blade is arranged parallel to and in the horizontal plane, which comprises the first intersection line, the first angle is 0°.

If the first folding blade plane is oriented at an acute angle to the horizontal plane, preferably the first angle is an acute angle of greater than 0° and less than 90°. Preferably the acute angle is between 5° and 85°, preferably between 15° and 75°, further preferably between 30° and 60°, particularly preferably between 40° and 50°. In the two last preferred regions, the overall height of the blade folding unit is relatively low, while at the same time an easy accessibility to the components of the blade folding unit is ensured for service personnel. It goes without saying, however, that in principle any angle can be selected from the specified ranges and thus all values contained in the ranges can also be regarded individually as belonging to the invention.

In a preferred embodiment, the folding machine also comprises a first conveying device with an endless first conveying means and an endless second conveying means for conveying foldable products to the first blade folding unit. The first and the second conveying means run parallel to one another from an inlet region to an outlet region of the first conveying device, in order to receive foldable products therebetween. The first conveying means is configured to carry a foldable product at least in the inlet region, and the second conveying means is configured to hold down a foldable product on the first conveying means at least in the inlet region. The first and the second conveying means are arranged in the outlet region in each case substantially parallel to the first folding roller plane, wherein the first blade folding unit is arranged in the retracted position closer to a portion of the first conveying means in the outlet region than to a portion of the second conveying means in the outlet region. As a result, the first conveying device conveys foldable products into the folding region between the first and the second folding roller and the first folding blade such that in each case the lower face of a foldable product faces the folding blade. For example, the first and the second conveying means can comprise in each case a band conveying device or belt conveying device.

Preferably, an upper run of the first conveying means and a lower run of the second conveying means run from the inlet region to the outlet region of the first conveying device parallel to one another and receive at least one foldable product therebetween. The first conveying means carries or supports the foldable products to be conveyed at least in the inlet region and the second conveying means holds down the foldable products to be conveyed on the first conveying means. The first conveying means are thus in contact with the lower face of the foldable product respectively to be conveyed, and the second conveying means are in contact with the upper face of the foldable product respectively to be conveyed.

Preferably, the second conveying means is arranged in the inlet region above the first conveying means. In this case, it is preferred if the first and second conveying means overlap one another. It is, however, also conceivable that the first and second conveying means are offset to one another in a horizontal direction transversely to the conveying direction.

Generally in all of the embodiments, preferably a plurality, preferably two, first conveying means which run spaced apart and parallel to one another can be present. Preferably a plurality, preferably two, second conveying means which run spaced apart and parallel to one another can also be present. If in each case a plurality of first and second conveying means are present, it is preferred if in each case a first conveying means and an associated second conveying means run in the same plane.

In a preferred embodiment, the first and second conveying means are generally thin endless bands or belts which are driven and receive or clamp one or more portions of the foldable product therebetween. At the same time, the foldable product is preferably not intended to be covered completely by the conveying means, so that it is accessible for processing and/or quality control during the conveyance.

The contents of the two paragraphs above also apply to all other conveying means described in this application, for example the third and fourth conveying means.

If the first folding blade plane is in the horizontal plane which comprises the first intersection line and thus is oriented horizontally, the first and the second conveying means preferably run vertically in the outlet region. In the inlet region the first and the second conveying means are preferably arranged substantially horizontally or slightly inclined, in order to permit foldable products to be received from upstream units in a simple manner. The first and second conveying means are then correspondingly deflected between the inlet region and the outlet region, preferably exclusively around deflection rollers which have a horizontal axis.

If the first folding blade plane is perpendicular to the horizontal plane which comprises the first intersection line, and thus is oriented substantially vertically, in the outlet region the first and the second conveying means preferably run horizontally and are arranged one above the other in the vertical direction. Then the second conveying means is also arranged in the outlet region above the first conveying means. A deflection of the first and the second conveying means between the inlet region and the outlet region is not required.

In a preferred embodiment, the folding machine also comprises a second conveying device with an endless third conveying means and an endless fourth conveying means for conveying products away from the first blade folding unit. The third and the fourth conveying means run parallel to one another from an inlet region to an outlet region of the second conveying device in order to receive products therebetween, wherein the inlet region opposes the first folding blade relative to the first folding roller plane. By means of the second conveying device, products which are folded by the first blade folding unit are conveyed further to an outlet of the folding machine or to further folding units.

The third and the fourth conveying means can be inclined in the inlet region, in each case substantially parallel to the first folding blade plane or relative to the first folding blade plane. Additionally, the third and the fourth conveying means can be arranged substantially symmetrically to or above the horizontal plane which comprises the first intersection line.

If the first folding blade plane is arranged in the horizontal plane which comprises the first intersection line, the third and the fourth conveying means are preferably arranged symmetrically to this horizontal plane, at least in the inlet region. Preferably, the third and the fourth conveying means are then arranged in each case substantially parallel to the first folding blade plane in the inlet region, and run horizontally from the inlet region to the outlet region.

If the first folding blade plane is arranged at an acute angle or perpendicularly to the horizontal plane which comprises the first intersection line, the third and fourth conveying means are arranged above this horizontal plane in the inlet region. Preferably, the third and the fourth conveying means are thus inclined in the inlet region in each case relative to the first folding blade plane, in order to initiate a deflection of the products starting from the inlet region to a horizontal plane in the outlet region. The third and the fourth conveying means, however, can also be arranged in the inlet region substantially symmetrically to the first folding blade plane.

In order to increase the flexibility and variety of folded products which can be produced, the folding machine preferably comprises at least one second blade folding unit. The second blade folding unit comprises by definition a third and a fourth folding roller, wherein the third folding roller has a third folding roller axis and the fourth folding roller has a fourth folding roller axis which is arranged spaced apart and parallel to the third folding roller axis, so that the third and the fourth folding roller axes define a second folding roller plane. The second blade folding unit also comprises a second folding blade which is oriented and movable in a second folding blade plane. The second folding blade plane is oriented perpendicularly to the second folding roller plane and intersects the second folding roller plane in a second intersection line. The second folding blade is movable between a retracted position and an extended position, wherein the second folding blade is arranged in the extended position closer to the second folding roller plane than in the retracted position. The second folding blade is arranged in the retracted position above a horizontal plane which comprises the second intersection line. This definition of the "second blade folding unit" encompasses all blade folding units in which the blade acts from above on the products, irrespective of the orientation of the folding blade to the transport direction of the product before the folding action.

As a result, the second folding blade acts on an upper face of a foldable product which is arranged in the folding region between the second folding blade and the third and fourth folding rollers. The second blade folding unit thus generates a fold in the foldable product in the opposing direction to the first blade folding unit.

A simple and cost-effective construction is achieved when the second blade folding unit is formed by a conventional blade folding unit. The second folding blade plane is in this case oriented perpendicularly to the horizontal plane and the second folding blade is arranged above the second folding roller plane and the foldable product.

Moreover, the statements made relative to the first blade folding unit also relate to the second blade folding unit.

The at least one second blade folding unit can be arranged in the folding machine relative to a transport direction of the folding machine upstream and/or downstream of the first blade folding unit. The folding machine can also comprise further blade folding units which are configured in each case so as to correspond to the first or the second blade folding unit.

In a preferred embodiment, the folding machine also comprises a buckle folding unit which is configured to fold a foldable product repeatedly in parallel in a first direction. At least the first blade folding unit is then configured to fold a product, which has been folded by the buckle folding unit, in a second direction perpendicularly to the first direction, i.e. in a cross-fold region relative to the folds formed by the buckle folding unit.

Preferably, the buckle folding unit is a multi-part buckle folding unit and forms the first folding unit in the transport direction of the folding machine. Preferably, at least one first blade folding unit follows the buckle folding unit, preferably at least a first and a second blade folding unit in any sequence.

It is preferred here if the second blade folding unit is arranged such that it undertakes the first folding action in the second direction and the first blade folding unit is arranged downstream of the second blade folding unit such that it folds the foldable product once again in the second direction.

It is also preferred if a further second blade folding unit is arranged downstream of the first blade folding unit, such that it folds the product once again in the second direction.

In a particularly preferred embodiment, in the cross-fold region in which folding actions are carried out in the second direction, the folding machine has exclusively first and second blade folding units, but no buckle folding unit. As a result, the automation of the folding machine settings can be possible in a simpler manner, since the blade folding units are more readily available for automation.

In the cross-fold region, therefore, for example a total of exactly three, four or five blade folding units can be arranged one after the other, exactly one or exactly two thereof being first blade folding units and the remaining blade folding units being second blade folding units.

According to another aspect of the invention, a method for folding products by means of a blade folding unit which comprises a first and a second folding roller and a folding blade, comprises the steps of:

- receiving a foldable product by means of a conveying device in an inlet region of the conveying device such that the foldable product is received between a first endless conveying means and a second endless conveying means of the conveying device, wherein the first conveying means bears against a lower face of the foldable product which faces downwardly in the inlet region, and the second conveying means bears against an upper face of the foldable product which faces upwardly in the inlet region;
- conveying the foldable product by means of the conveying device in a conveying direction from the inlet region to an outlet region of the conveying device which is arranged adjacent to a folding region between the folding blade and the first and the second folding roller, wherein between the inlet region and the outlet region the orientation of the foldable product is maintained relative to a longitudinal axis of the foldable product, which is oriented parallel to the conveying direction in the inlet region;
- arranging the foldable product in the folding region, wherein the upper face of the foldable product faces the first and second folding roller and the lower face of the foldable product faces the folding blade;
- moving the folding blade in a folding blade plane in the direction of the lower face of the foldable product, and the folding blade acting on the lower face of the foldable product so that the foldable product is forced between the first and the second folding roller; and pulling the foldable product through the first and second folding rollers and thereby generating a fold line transversely to the longitudinal axis of the foldable product.

In this manner, a method for folding foldable products by means of a blade folding unit is provided, in which the folding blade acts on a lower face of the foldable product, while the folding blade of the hitherto known blade folding units acts on the upper face of the foldable product. As a result, it is possible to fold foldable products in the opposing direction in comparison with the hitherto known blade folding units, whereby the flexibility is increased in the configuration of the foldable products by blade folding units. Without sacrificing flexibility, a buckle folding unit can be dispensed with in the cross-fold region, whereby costs can be saved and installation times reduced.

Preferably, the method comprises the specified steps in the specified sequence.

Preferably, the specified steps are repeated for each product to be folded.

In a preferred embodiment, the method according to this aspect of the invention is carried out by means of a folding machine as described above. The blade folding unit thus corresponds to the first blade folding unit of the folding machine according to the invention and the conveying device can correspond to the first conveying device.

All of the statements made relative to the folding machine according to an aspect of the invention, in particular relative to the first blade folding unit and the first conveying device, preferably relate equally to the method according to another aspect of the invention and vice versa.

The conveying direction is defined by the first and the second conveying means and extends in each portion under consideration parallel to the associated portion of the first conveying means and to the associated portion of the second conveying means. The conveying direction can remain unchanged from the inlet region to the outlet region, for example oriented substantially horizontally. The conveying direction, however, can also be changed between the inlet region and the outlet region, for example when the conveying means are deflected.

The longitudinal axis of the foldable product is defined as the axis of the foldable product, which in the inlet region is arranged parallel to the conveying direction. The longitudinal axis is preferably oriented in each portion of the conveying device parallel to the conveying direction.

As the orientation of the foldable product relative to the longitudinal axis is maintained between the inlet region and the outlet region, the simplest possible guidance of the first and second conveying means is possible between the inlet region and the outlet region. In particular, the conveying means are not rotated relative to one another about an axis parallel to the conveying direction, nor is the foldable product rotated between the inlet region and the outlet region about the longitudinal axis.

During the conveyance of a foldable product by means of the conveying device, a leading edge in the conveying direction is preferably always oriented horizontally. As a result, firstly the folding machine can be configured as simply as possible and secondly it is possible to avoid acceleration forces which act, for example, on the sensitive products during a rotation about the longitudinal axis or about an axis parallel to the conveying direction. A substantially straight reference line is to be understood as the edge.

Preferably, a foldable product, which is conveyed by means of the conveying device, has in the outlet region the same relative arrangement regarding the first and second conveying means as in the inlet region, whereby a more gentle transport is possible.

Preferably, the movement of the folding blade takes place in one direction which is oriented horizontally when the first folding blade is arranged in the retracted position in a horizontal plane. Alternatively, the movement of the folding blade takes place in a direction which is oriented upwardly when the first folding blade is arranged in the retracted position at an acute angle or perpendicularly to a horizontal plane. In both cases, the horizontal plane preferably corresponds to the horizontal plane which comprises the first intersection line.

It goes without saying that an angle of the direction in which the folding blade moves correlates with the angle of the folding blade plane to the horizontal plane.

In one embodiment, the folding blade is arranged in the retracted position below the foldable product.

The arrangement of the foldable product in the folding region preferably takes place such that the foldable product is arranged parallel to a folding roller plane which comprises a first folding roller axis of the first folding roller and a second folding roller axis of the second folding roller. Preferably, the folding roller plane of the first folding roller plane corresponds to the folding machine according to the invention.

A foldable product is conveyed by means of the conveying device into the folding region and is conveyed with the leading edge of the foldable product against a stop which defines a folding position of the foldable product in the folding region. The foldable product additionally has a trailing edge opposite this leading edge.

Preferably, the folding blade is arranged lower than the trailing edge of a foldable product in the folding region. As a result, it is possible for the folding blade to act on the lower face of the foldable product, in spite of a simple construction of the folding machine.

Finally, it is preferred that the second conveying means is arranged in the inlet region above the first conveying means, so that the upper face of the foldable product faces upwardly in the inlet region of the conveying device and the lower face of the foldable product faces downwardly in the inlet region of the conveying device. As described above, the first and the second conveying means in this case do not necessarily have to overlap one another.

In a preferred embodiment, the (first) folding blade plane is oriented perpendicularly to a horizontal plane and the folding blade is moved in the vertical direction upwardly and in the direction of the lower face of the foldable product in order to act thereon. It is thus preferred if the first conveying means and the second conveying means extend substantially horizontally from the inlet region to the outlet region. No deflection of the foldable products takes place between the inlet region and the outlet region of the conveying device. Thus no acceleration forces act transversely to the conveying direction on the sensitive foldable products and a transport which is as gentle as possible is ensured.

In a further preferred embodiment, the (first) folding blade plane is oriented in a horizontal plane and thus forms a horizontal plane and the folding blade is moved in the horizontal direction onto the lower face of the foldable product in order to act thereon. It is thus preferred if the first and the second conveying means are oriented substantially horizontally or slightly inclined in the inlet region of the conveying device, so that they can receive substantially horizontally conveyed foldable products. The first and the second conveying devices can be deflected between the inlet region and the outlet region of the conveying device such that they are oriented substantially vertically in the outlet region. Preferably, the first and the second conveying means in this case are merely deflected around deflection rollers which have a horizontal axis. In particular, the first and the second conveying means are not rotated relative to one another about an axis running longitudinally relative to the conveying direction.

BRIEF DESCRIPTION OF THE DRAWINGS

FIG. 2*b* shows a folding blade of the folding machine shown in FIG. 2*a* in a retracted position.

FIG. 2*c* shows a folding blade of the folding machine shown in FIG. 2*a* in an extended position.

FIG. 3 shows schematically a folding unit of a further alternative embodiment of a folding machine according to an aspect of the invention.

DETAILED DESCRIPTION OF SPECIFIC EMBODIMENTS

Figure 1A:
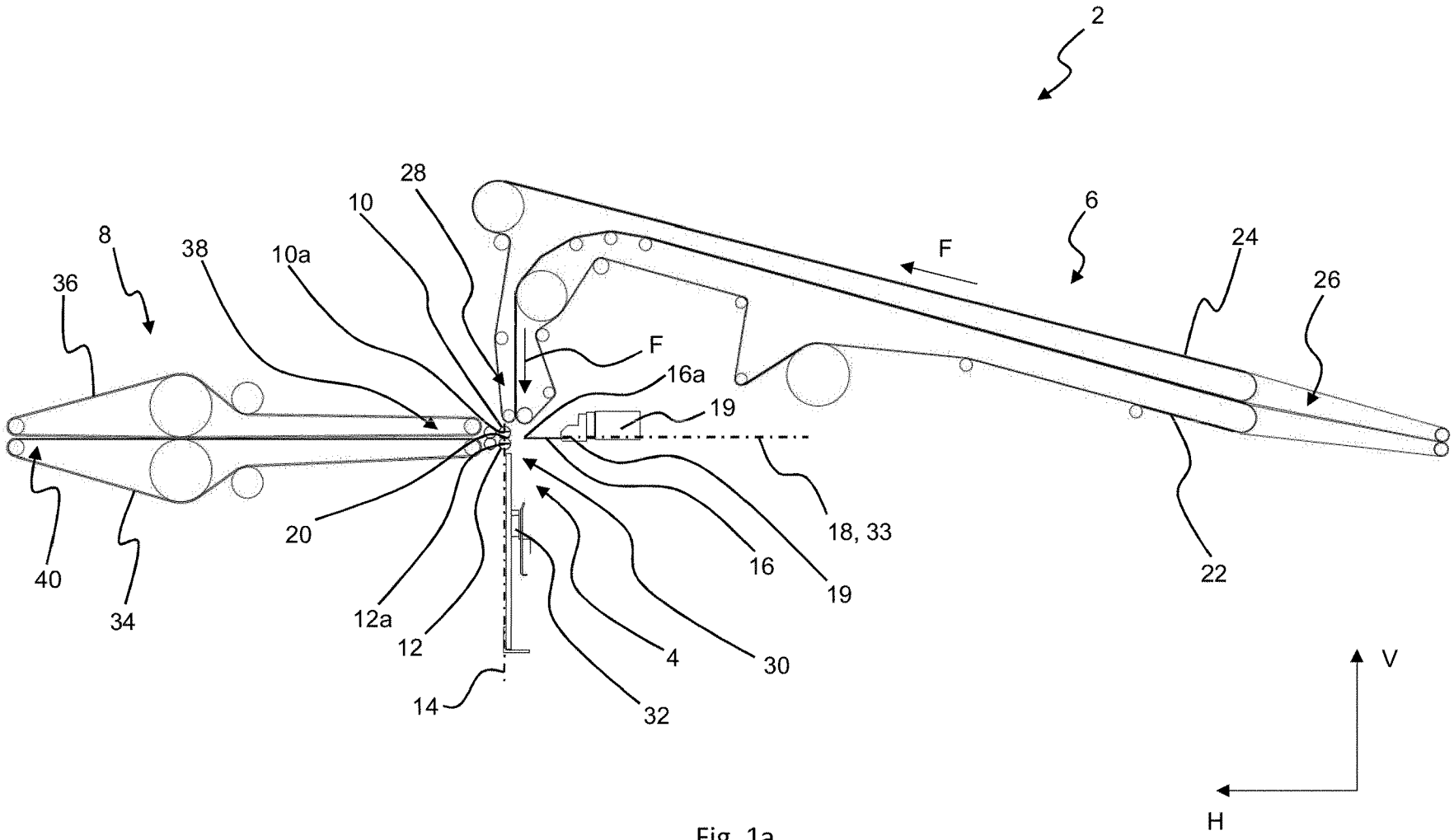
FIG. 1*a* shows essential components of a folding machine according to an aspect of the invention according to a first embodiment in a schematic cross-sectional view.

FIG. 1*a* shows the essential components of a folding machine 2 according to an aspect of the invention, according to a first embodiment in a cross-sectional view. The folding machine 2 comprises a first blade folding unit 4 for folding foldable products (see FIG. 1*b*), a first conveying device 6 for conveying foldable products to the first blade folding unit 4 and a second conveying device 8 for conveying products, which have been folded by the first blade folding unit 4, away from the blade folding unit 4. The first blade folding unit 4, the first conveying device 6 and the second conveying device 8 are mounted in a machine frame of the folding machine 2, which is not shown in FIG. 1*a* for better clarity, but for example can be seen in FIG. 4*a*.

As a reference, a horizontal plane H and a vertical plane V in FIGS. 1 to 4 are indicated by arrows in the respective cross-sectional view. FIG. 5 is a plan view, in which the drawing plane is parallel to a horizontal plane.

The first blade folding unit 4 comprises a first folding roller 10 and a second folding roller 12. The first folding roller 10 has a first folding roller axis 10*a* and the second folding roller 12 has a second folding roller axis 12*a*. The second folding roller axis 12*a* is arranged spaced apart and parallel to the first folding roller axis 10*a* so that the folding roller axes 10*a*, 12*a* define a first folding roller plane 14 which is indicated in dashed lines in FIG. 1*a*. In the embodiment shown, the first folding roller plane 14 is oriented vertically.

The first blade folding unit 4 also comprises a first folding blade 16. The first folding blade 16 is oriented and movable in a first folding blade plane 18 which is indicated in dashed lines in FIG. 1*a*. The first folding blade plane 18 is oriented perpendicularly to the first folding roller plane 14. In the embodiment shown, the first folding blade plane 18 is oriented substantially horizontally. The first folding blade 16 has a front edge 16*a* which is oriented parallel to the folding roller axes 10*a*, 12*a* and which is located in the folding blade plane 18. In an end portion 16*b* which opposes the front edge 16*a*, the first folding blade 16 is clamped and connected to a drive device 19.

The first folding blade plane 18 intersects the first folding roller plane 14 in a first intersection line 20. The first intersection line 20 is oriented parallel to the first and second folding roller axis 10*a*, 12*a* and preferably arranged symmetrically therebetween in the folding roller gap between the folding rollers 10, 12.

The first conveying device 6 comprises a first endless conveying means 22 and a second endless conveying means 24 which preferably in each case comprise at least one conveying belt or conveying band which are deflected around at least two deflection rollers, at least one thereof being driven. The first and the second conveying means 22, 24 run from an inlet region 26 to an outlet region 28 of the first conveying device 6 parallel to one another in order to receive foldable products therebetween and to convey the foldable products in the conveying direction F into a folding region 30 between the folding rollers 10, 12 and the folding blade 16.

In the embodiment shown, an upper run 22*a* of the first conveying means 22 and a lower run 24*a* of the second conveying means 24 form the transport path of the foldable products between the inlet region 26 and the outlet region 28. From the outlet region 28, the lower run of the first conveying means 22 and the upper run of the second conveying means 24 are guided via deflection rollers back to the inlet region 26.

Figure 1B:
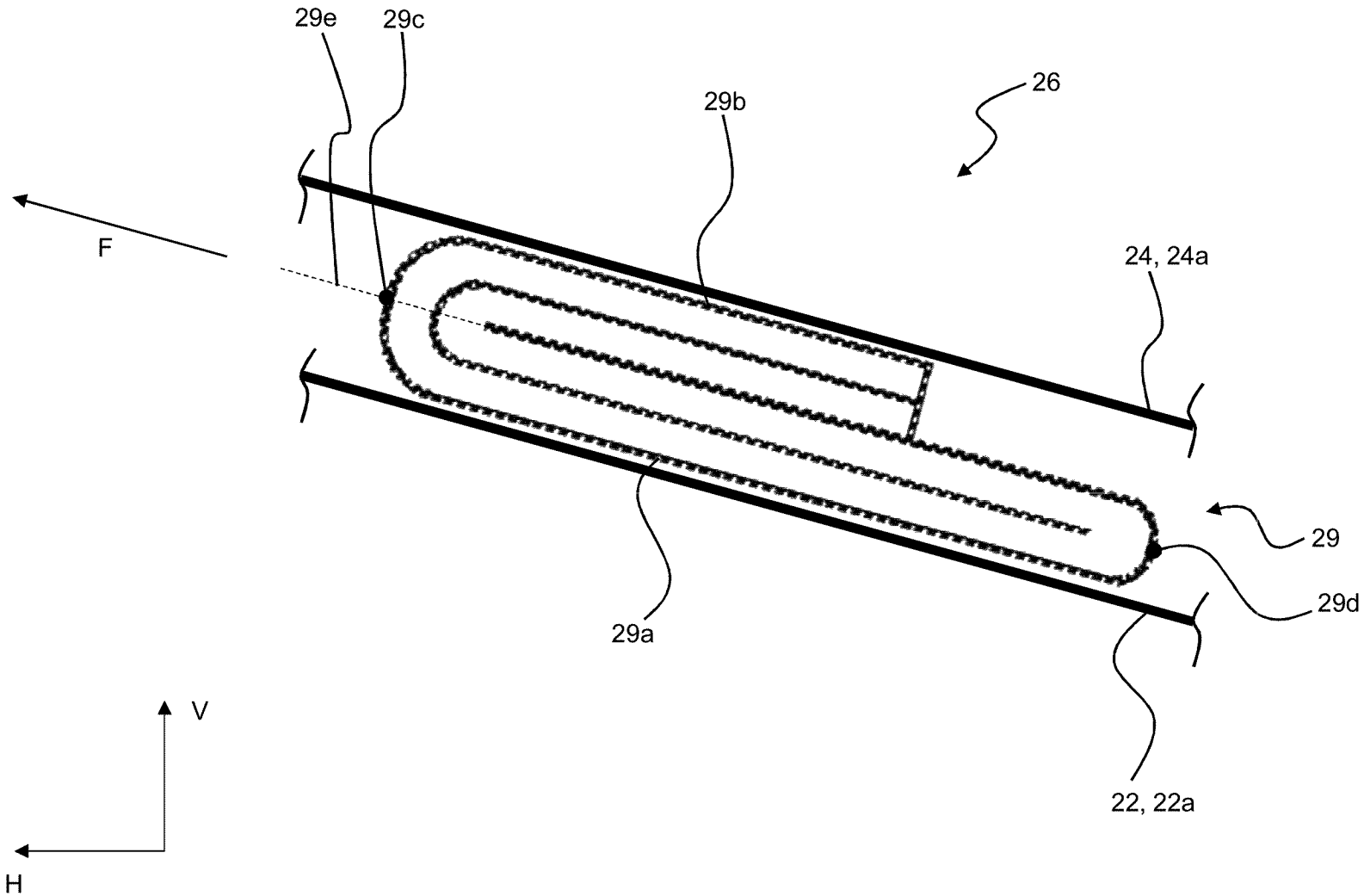
FIG. 1*b* shows a detail of the folding machine shown in FIG. 1*a*.

In FIG. 1*b* a detail of the inlet region 26 of the first conveying device 6 with an exemplary product 29 is shown enlarged. It goes without saying that all other types of foldable products are correspondingly conveyed by the conveying device 6.

The second conveying means 24 is arranged at least in the inlet region 26 above the first conveying means 22. The conveying device 6 receives a foldable product 29 in the inlet region 26 such that the first conveying means 22 bears against a lower face 29*a* of the foldable product 29 which faces downwardly in the inlet region 26, and the second conveying means 24 bears against an upper face 29*b* of the foldable product 29, which faces upwardly in the inlet region 26. The foldable product 29 additionally has a leading edge 29*c* relative to the conveying direction F, and a trailing edge 29*d* which opposes the leading edge 29*c*. A longitudinal axis 29*e* of the foldable product 29 extends parallel to the conveying direction F.

In the inlet region 26, the first conveying means 22 carries or supports the foldable products 29 to be conveyed and the second conveying means 24 holds down the foldable products 29 to be conveyed on the first conveying means 22. As a result, the foldable products 29 to be conveyed are received non-positively between the first and the second conveying means 22, 24. In the outlet region 28, the first and the second conveying means 22, 24 are arranged substantially parallel to the first folding roller plane 14. In the embodiment shown in FIG. 1*a*, the first and second conveying means 22, 24 are oriented vertically in the outlet region 28.

During the conveyance of a foldable product 29 from the inlet region 26 to the outlet region 28, the orientation of the foldable product 29 is maintained relative to an axis parallel to the conveying direction F between the inlet region 26 and the outlet region 28. In particular, the first and the second conveying means 22, 24 maintain their arrangements relative to the conveying direction F. The leading edge 29*c* of the foldable product 29 is preferably always horizontally oriented while the foldable product 29 is conveyed by the first conveying device 6.

In the embodiment shown, this leads to the first and the second conveying means 22, 24 being arranged in the inlet region 26 one above the other in the vertical direction and being arranged in the outlet region 28 horizontally adjacent to one another. The relative arrangement thereof does not change, but the first and the second conveying means 22, 24 are correspondingly deflected between the inlet region and the outlet region 26, 28.

Foldable products 29 are conveyed by the first conveying device 6 from the outlet region 28 into the folding region 30 and arranged in the folding region 30 such that the upper face 29*b* thereof faces the first and the second folding rollers 10, 12, and the lower face 29*a* thereof faces the folding blade 16. A foldable product 29 to be folded is arranged in the folding region 30 parallel to the folding roller plane 14. In the folding region 30, the foldable product 29 is conveyed with the leading edge 29*c* as far as an adjustable stop 32. The stop 32 defines the position of the foldable product 29 relative to the folding blade 16 and the folding rollers 10, 12.

In FIG. 1*a* the first folding blade 16 is in a retracted position (see FIG. 1*c*) in which it frees up the outlet of the first conveying device 6 so that the foldable product 29 can be conveyed unhindered against the stop 32. As a result, the folding blade 16 is arranged in the retracted position closer to a portion of the first conveying means 22 in the outlet region 28 than to a portion of the second conveying means 24 in the outlet region 28.

From the retracted position, the first folding blade 16 is movable into an extended position (see FIG. 1*d*) in which it is arranged closer to the first folding roller plane 14 than in the retracted position. By moving from the retracted position into the extended position, the folding blade 16 is moved in the direction of the lower face 29*a* of the foldable product 29 which is arranged in the folding region 30, strikes the foldable product 29 with the front edge 16*a* and forces the foldable product 29 between the first and the second folding roller 10, 12. The foldable product 29 is then pulled through the first and the second folding roller 10, 12, whereby a fold line is generated in the first blade folding unit 4.

Figures 1C, 1D:
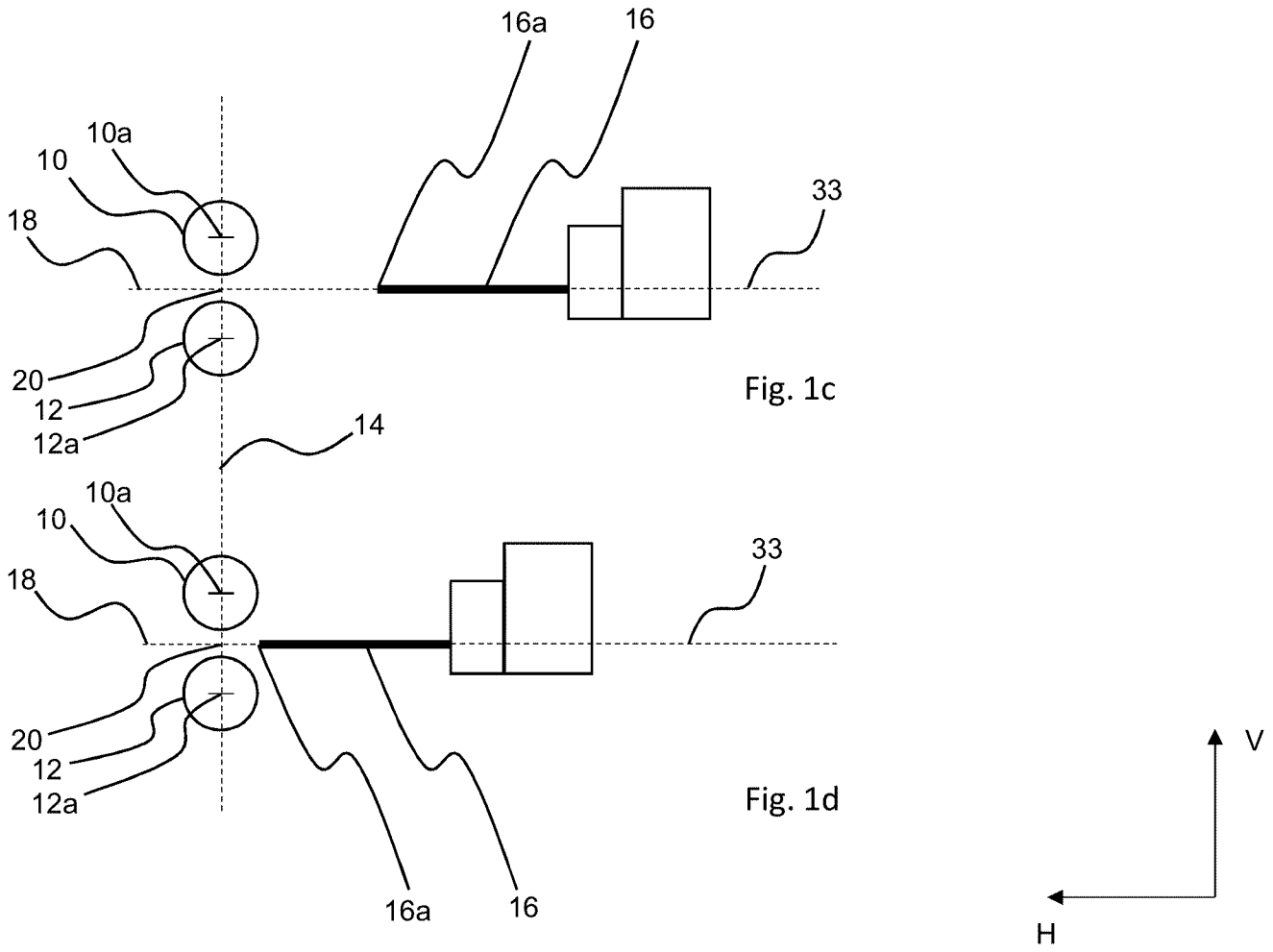
FIG. 1*c* shows a folding blade of the folding machine shown in FIG. 1*a* in a retracted position.
FIG. 1*d* shows a folding blade of the folding machine shown in FIG. 1*a* in an extended position.

In FIGS. 1*c* and 1*d* the first and the second folding roller 10, 12 and the first folding blade 16 of the first blade folding unit 4 are shown enlarged, wherein the folding blade 16 is shown in FIG. 1*c* in the retracted position and is shown in FIG. 1*d* in the extended position.

According to an aspect of the invention, the first folding blade 16 is arranged in the retracted position in or below a horizontal plane 33 which comprises the first intersection line 20.

In the embodiment according to FIG. 1, the first folding blade plane 18 is oriented in the horizontal plane 33 which comprises the first intersection line 20. The first folding blade 16 is thus oriented in the horizontal plane 33 and the folding blade plane 18 forms the horizontal plane 33. The front edge 16*a* of the first folding blade is then preferably oriented horizontally and parallel to the first intersection line 20. An angle between the first folding blade plane 18 and the horizontal plane 33 in this case is 0°.

The first folding blade 16 in this case strikes from the side onto the lower face 29*a* of a foldable product 29 oriented vertically in the folding region 30. The foldable product 29 is folded by means of the first blade folding unit 4 such that the lower face 29*a* of the foldable product 29 is folded inwardly and the upper face 29*b* of the foldable product 29 is folded outwardly and thus forms a new upper face and a new lower face of the product folded by the blade folding unit 4. In contrast thereto, conventional blade folding units strike against the upper face of a foldable product so that the upper face of the foldable product is folded inwardly.

By means of the first blade folding unit 4, the number of possible folding directions and designs can be increased in the folding machine 2 without the use of a buckle folding unit, whereby the flexibility and product variety are increased in the production of folded products. An easy accessibility and simple adjustability of the first blade folding unit 4 is permitted by the substantially horizontal arrangement of the first folding blade 16, and the resulting arrangement of the folding rollers 10, 12 and the folding blade 16 substantially adjacent to one another.

The second conveying device 8 receives a product which has been folded by the first blade folding unit 4 and conveys it away from the blade folding unit 4, for example in the direction of a downstream folding unit. The second conveying device 8 comprises an endless third conveying means 34 and an endless fourth conveying means 36 which run parallel to one another from an inlet region 38 of the second conveying device 8 to an outlet region 40 of the second conveying device 8, in order to receive products therebetween. Preferably, the third and fourth conveying means 34, 36 in each case comprise at least one conveying band or conveying belt.

In order to receive a product downstream of the first blade folding unit 4, the third and the fourth conveying means 34, 36 in the inlet region 38 oppose the first folding blade 16 relative to the first folding roller plane 14. In this case, the third and the fourth conveying means 34, 36 in the inlet region 38 can be oriented in each case substantially parallel to the first folding blade plane 18. In the embodiment according to FIG. 1*a*, the third and fourth conveying means 34, 36 in the inlet region 38 are thus oriented horizontally and arranged symmetrically to the horizontal plane 33 which comprises the first intersection line 20, or to the first folding blade plane 18.

Preferably, the third and the fourth conveying means 34, 36 in the outlet region 40 of the second conveying device 8 are oriented horizontally in order to permit the simplest possible transfer to downstream units. In the embodiment shown, the third and the fourth conveying means 34, 36 thus extend substantially linearly and horizontally from the inlet region 38 to the outlet region 40, resulting in a very simple construction of the second conveying device 8.

Figure 2A:
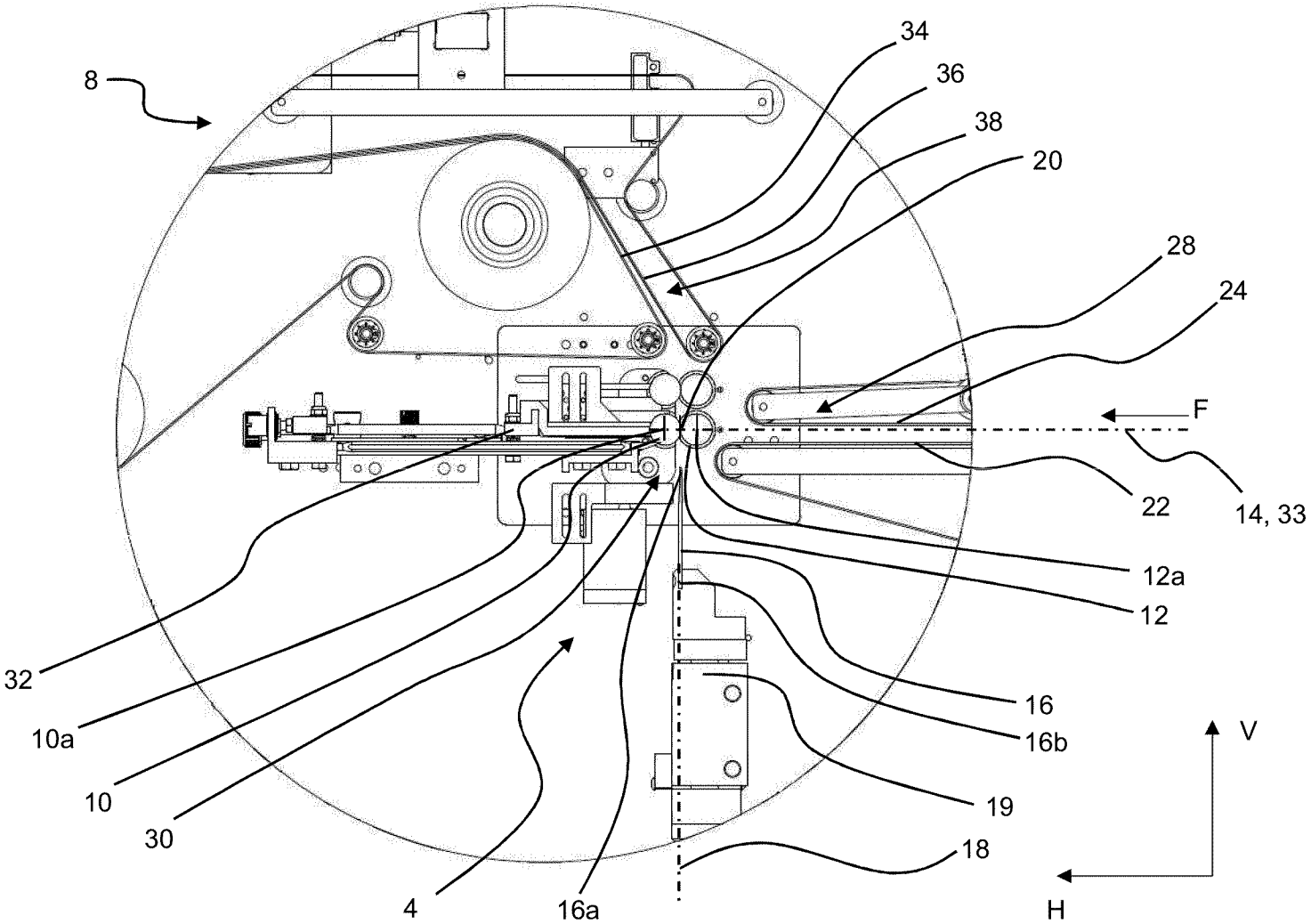
FIG. 2*a* shows essential components of a folding machine according to an aspect of the invention according to a second embodiment in a schematic cross-sectional view.

In FIG. 2*a* a detail of a folding machine 2 according to a second embodiment is shown. Unless specified otherwise hereinafter, the statements made relative to the embodiments according to FIGS. 1*a* and 1*b* also relate equally to the embodiment according to FIG. 2*a*.

The embodiment according to FIG. 2*a* substantially differs from the embodiment according to FIGS. 1*a* and 1*b* in the arrangement of the folding roller plane and folding blade plane 14, 18 and the arrangement and guidance of the conveying means 22, 24, 34, 36 associated therewith.

In FIGS. 2*b* and 2*c* the first and the second folding roller 10, 12 and the first folding blade 16 of the first folding blade mechanism 4 of this embodiment are shown enlarged, wherein the folding blade 16 is shown in FIG. 2*b* in the retracted position and is shown in FIG. 2*c* in the extended position.

The first and the second folding roller 10, 12 of the first blade folding unit 4 are arranged horizontally adjacent to one another in this exemplary embodiment. The first folding roller plane 14, which is defined by the first and the second folding roller axis 10*a*, 12*a*, is oriented horizontally and thus forms a horizontal plane.

The first folding blade 16 is oriented in the first folding blade plane 18 which is oriented perpendicularly to the first folding roller plane 14 and thus perpendicularly or at an angle of 90° to a horizontal plane. The first folding blade plane 18 intersects the first folding roller plane 14 in the first intersection line 20. As a result, in this embodiment a horizontal plane 33 which comprises the first intersection line 20 is formed by the first folding roller plane 14.

The first folding blade 16 is arranged in the retracted position shown (see also FIG. 2*b*) below the horizontal plane 33 which comprises the first intersection line 20, and thus below a foldable product arranged in the folding region 30. From the retracted position, the first folding blade 16 is moved upwardly in the folding blade plane 18, strikes against the lower face of a foldable product arranged in the folding region 30 and forces this foldable product between the folding rollers 10, 12.

A foldable product to be folded in the first blade folding unit 4 is arranged in the folding region 30 parallel to the first folding roller plane 14. In this embodiment, therefore, the first conveying means 22 and the second conveying means 24 run in the outlet region 28 substantially parallel to the first folding roller plane 14 and thus horizontally. The first and the second conveying means 22 and 24 can thus extend linearly and horizontally from the inlet region 26 to the outlet region 28 of the first conveying device 6, as shown for example in FIG. 1*a* for the second conveying device 8.

A product, which has been folded by the first blade folding unit 4, is subsequently received by the second conveying device 8 and conveyed from the inlet region 38 to the outlet region 40 of the second conveying device 8. The inlet region 38 is configured relative to the first folding roller plane 14 opposite the first folding blade 16 in order to receive a product which passes between the first and second folding roller 10, 12.

In the embodiment according to FIG. 2*a*, the third and the fourth conveying means 34, 36 are arranged in the inlet region 38 above the horizontal plane 33 which comprises the first intersection line 20, and thus above the first folding roller plane 14. The third and the fourth conveying means 34, 36 can be arranged in the inlet region 38 substantially parallel to the first folding blade plane 18 or, as shown, already inclined in the inlet region 38 relative to the first folding blade plane 18. As a result, a deflection of the conveyed product can be introduced into a substantially horizontal plane in which the product is preferably transferred to a downstream unit. The third and the fourth conveying means 34, 36 are thus also oriented horizontally in the outlet region 40 of the second conveying device 8.

In FIG. 3*a* detail of a folding unit of a folding machine 2 according to a further alternative embodiment is shown schematically. Unless specified otherwise, the statements made relative to the embodiments according to FIGS. 1 and 2 also relate equally to the embodiment according to FIG. 3. The embodiment according to FIG. 3 substantially differs from the embodiments according to FIGS. 1 and 2 in that the first folding blade 16 is oriented at a first angle $\alpha$ to the horizontal plane 33, wherein the first angle $\alpha$ is an acute angle.

Preferably, the first angle is defined between the horizontal plane 33 and the first folding blade plane 18, and namely on the side of the folding blade plane 18 on which the foldable products 29 are fed into a folding region 30 between the first and the second folding roller 10, 12 and the first folding blade 16. Additionally, the first angle $\alpha$ is defined below the horizontal plane 33 between the horizontal plane 33 and the first folding blade plane 18.

Figure 4A:
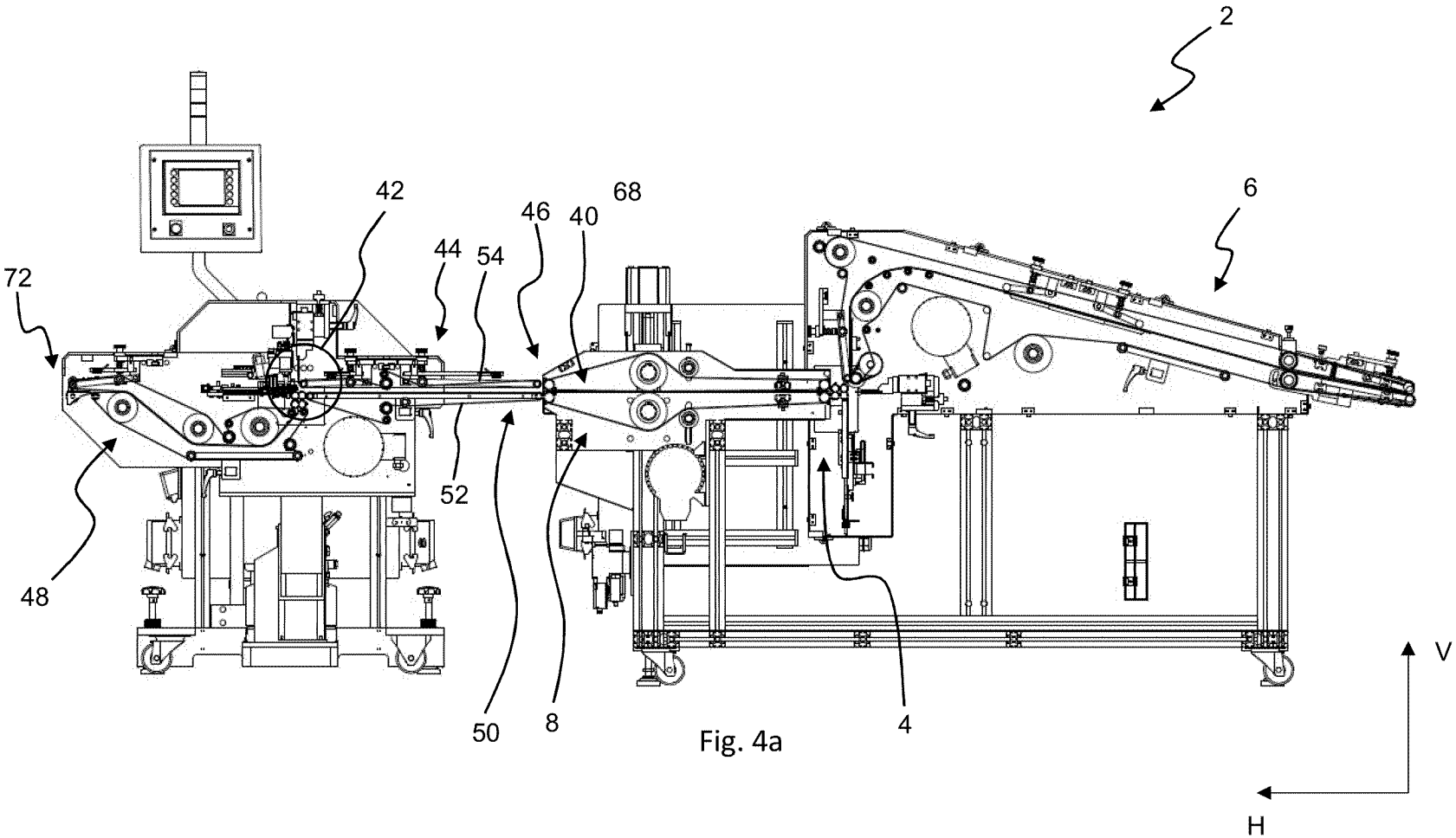
FIG. 4*a* shows a modified embodiment of the folding machine according to FIG. 1*a* in a schematic cross-sectional view.
Figures 4B, 4C:
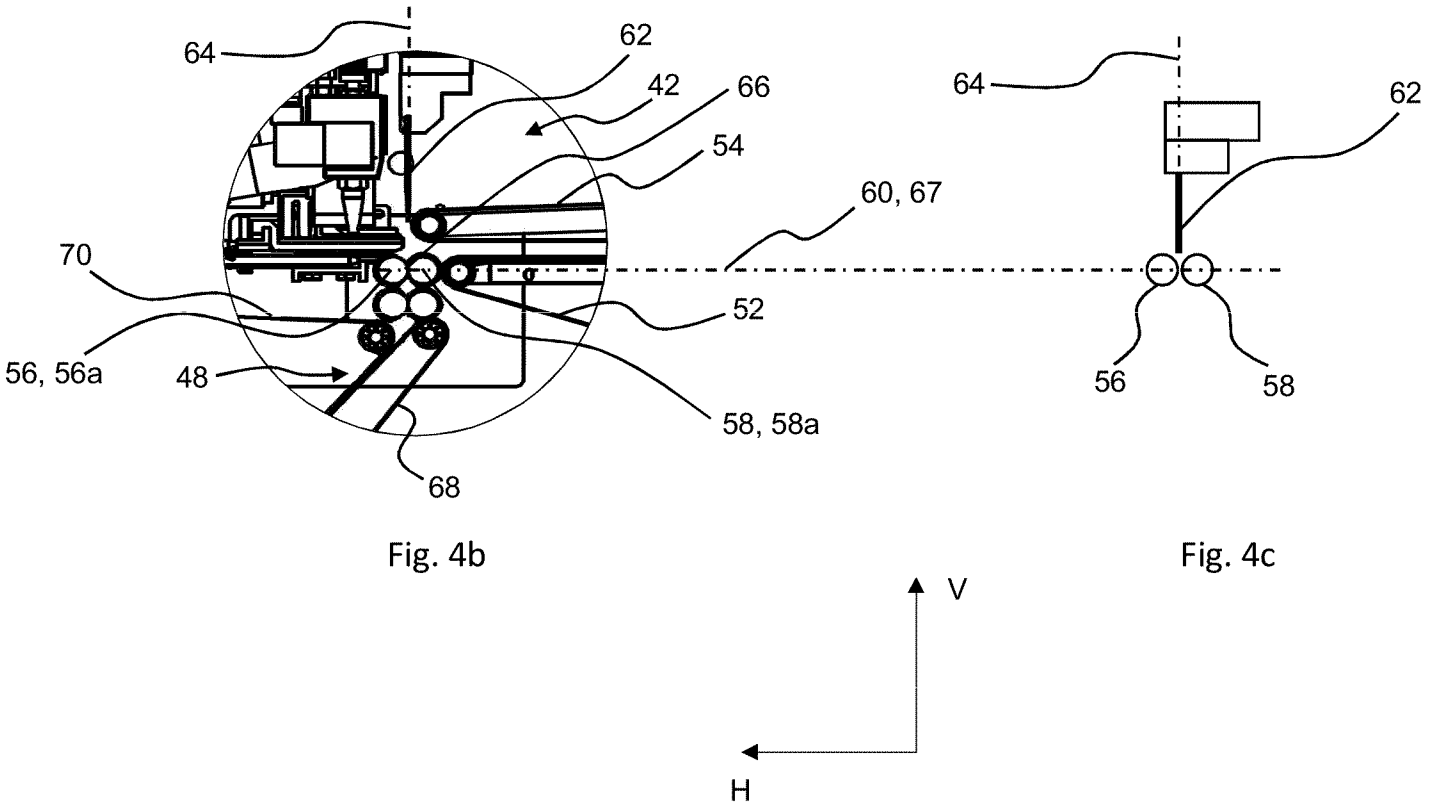
FIG. 4*b* is an enlarged view of a second blade folding unit shown in FIG. 4*a* with a folding blade in the retracted position.
FIG. 4*c* is an enlarged view of a second blade folding unit shown in FIG. 4*a* with a folding blade in the extended position.
Figure 5:
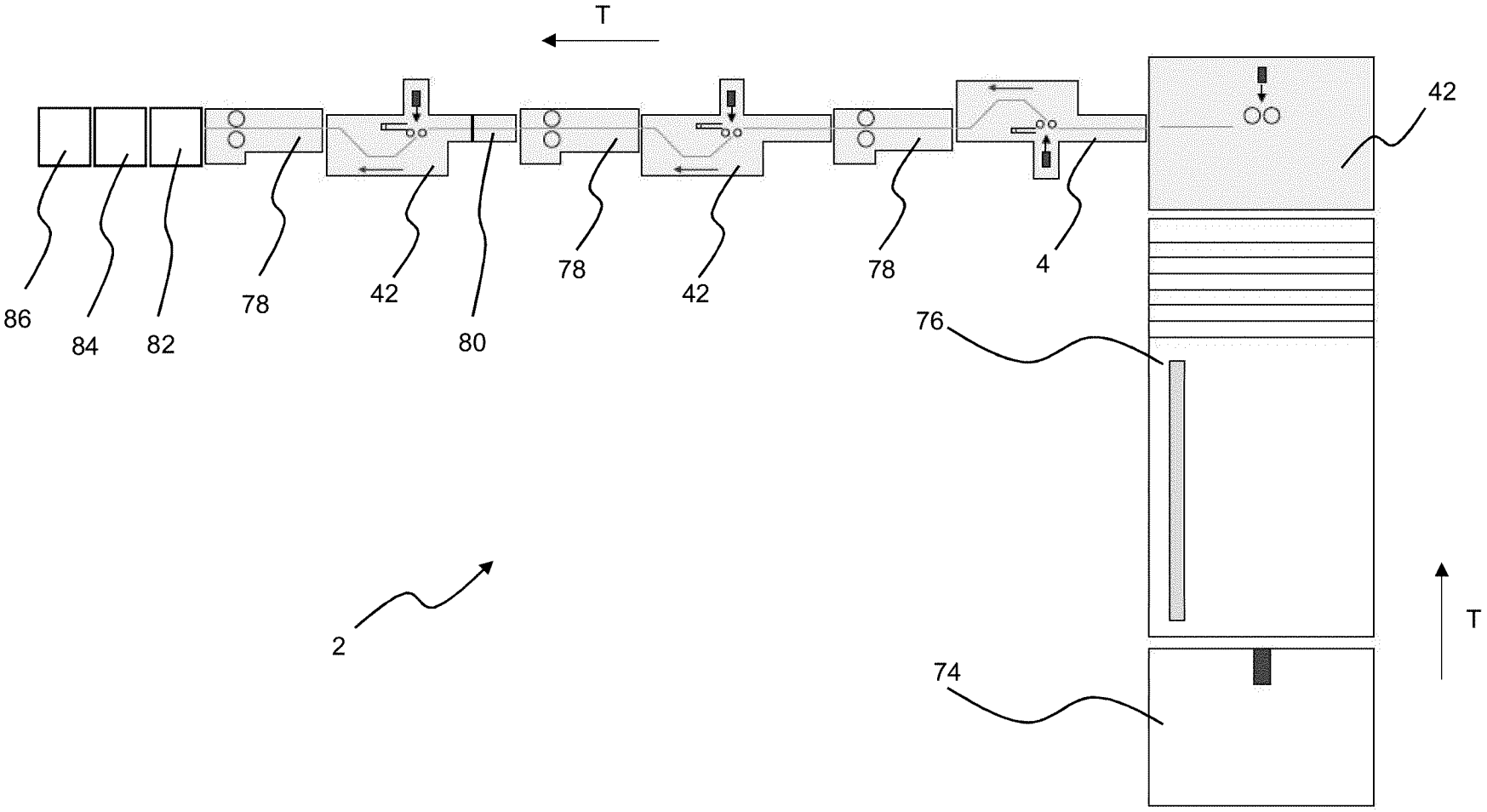
FIG. 5 is a schematic view of an embodiment of a folding machine according to the invention with a plurality of folding units.

A folding machine 2 which comprises a second blade folding unit 42 in addition to the first blade folding unit 4 is shown in FIGS. 4*a* and 4*b*. Preferably, the folding machine 2 is configured to be modular in order to be able to be configured in a flexible manner. Each blade folding unit 4, 42 is thus preferably configured to be mobile and has a separate drive and separate conveying devices 6, 8.

The folding machine 2 according to FIG. 4*a* comprises the first blade folding unit 4, the first conveying device 6 and the second conveying device 8 according to FIG. 1*a*, reference thus being made to the embodiments of FIGS. 1*a* and 1 *b* relative thereto.

Furthermore, the folding machine 2 comprises the second blade folding unit 42, a third conveying device 44 for conveying products from a transfer region 46 to the second blade folding unit 42 and a fourth conveying device 48 for conveying products away from the second blade folding unit 42.

In the transfer region 46, products are transferred from the second conveying device 8 to the third conveying device 44. As a result, the outlet region 40 of the second conveying device 8 and an inlet region 50 of the third conveying device 44 are arranged in the transfer region 46. Preferably, the third conveying device 44 comprises two endlessly circulating conveying means 52, 54 which are arranged in the inlet region 50 parallel to the third and the fourth conveying means 34, 36 and ideally at the same height. The conveying means 52, 54 can comprise in each case at least one conveyor belt or conveyor band.

The second blade folding unit 42 is shown enlarged in FIG. 4*b* and preferably corresponds to a conventional blade folding unit. Thus it is only described with the necessary brevity.

The second blade folding unit 42 comprises a third and a fourth folding roller 56, 58. The third folding roller 56 has a third folding roller axis 56*a* and the fourth folding roller 58 has a fourth folding roller axis 58*a* which is arranged spaced apart and parallel to the third folding roller axis 56*a*. The third and fourth folding roller axes 56*a*, 58*a* define a second folding roller plane 60. Moreover, the second blade folding unit 42 comprises a second folding blade 62 which is oriented and movable in a second folding blade plane 64. The second folding blade plane 64 is oriented perpendicularly to the second folding roller plane 60 and intersects the second folding roller plane 60 in a second intersection line 66. The second folding blade 62 is movable between the retracted position shown in FIG. 4*b* and an extended position shown in FIG. 4*c*.

If the second blade folding unit 42 corresponds to a conventional blade folding unit, the second folding blade plane 64 is oriented perpendicularly to a horizontal plane 67, which comprises the second intersection line 66, and the second folding blade 62 is arranged in the retracted position above this horizontal plane 67. The second folding blade 62 of the second blade folding unit 42 acts in principle on an upper face of a foldable product and folds this foldable product in the opposing direction in comparison with the first blade folding unit 4.

It goes without saying that the second folding blade plane 64 can also be oriented at any angle between 1° and 90° to the horizontal plane, wherein the second folding blade 62 is always arranged in the retracted position above the horizontal plane 67 which comprises the second intersection line 66.

Conveying means 68, 70 of the fourth conveying device 48 form an inlet region of the fourth conveying device 48 which is arranged relative to the second folding roller plane 60 opposite the second folding blade 62, in order to receive a product which has been folded by the second blade folding unit 42. Generally, the inlet region of the fourth conveying device 48 is arranged below the second folding roller plane 60. The conveying means 68, 70 of the fourth conveying device 48 convey the product to an outlet region 72 in which the conveying means 68, 70 are preferably oriented horizontally. Any further units, in particular further folding units, can follow the second blade folding unit 42.

FIG. 5 is a schematic view of an embodiment of a folding machine 2 according to the invention with a plurality of folding units 4, 42 in a plan view.

The folding machine 2 comprises firstly a feeder 74 for feeding and separating sheetshaped foldable products (foldable sheets) which can be provided in the feeder 74 as a stack.

Moreover, the folding machine 2 comprises a buckle folding unit 76 which is arranged downstream of the feeder 74 in a transport direction T. The feeder 74 in each case pulls off a foldable product from the stack and supplies this to the buckle folding unit 76. The buckle folding unit 76 is preferably configured to fold the foldable product repeatedly such that the folds run parallel to a first direction, i.e. a plurality of parallel folds are generated in the foldable product.

Then a cross-fold is introduced in the foldable product. Hitherto it was usual to use a further buckle folding unit for this purpose. In the embodiment shown, the cross-fold is generated by means of a blade folding unit which can correspond to a conventional blade folding unit regarding the essential components, as is described for example as the second blade folding unit 42 with reference to FIG. 4*a* and FIG. 4*b*. The difference, however, is the orientation of the second folding blade 62 relative to the transport direction of the foldable product. While in the second blade folding unit 42, described with reference to FIGS. 4*a* and 4*b*, the folding action is generated transversely to the transport direction of the foldable product, as is the case when the foldable product is fed in via the folding rollers 56, 58, here the folding action is generated in the transport direction of the foldable product, as is the case when the foldable product is fed in via the folding rollers 56, 58. The folding roller axes 56*a*, 58*a* are accordingly also arranged parallel to the transport direction of the foldable product, as is the case when the foldable product is fed in via the folding rollers 56, 58, and not transversely thereto, as shown in FIGS. 4*a* and 4*b*. When the cross-fold is generated, then the transport direction T of the foldable products changes in the folding machine 2, for example by 90°, as can be seen in FIG. 5, and thereafter the foldable products are folded in each case transversely to their transport direction.

Moreover, the folding machine 2 comprises in the cross-fold region a blade folding unit according to an aspect of the invention which corresponds to the first blade folding unit 4 and which is described with reference to FIGS. 1*a*, 1*b* and 2. Relative to the plurality of parallel folds which have been formed by the buckle folding unit 76, the blade folding unit 4 generates a further transverse fold in the same direction as in the blade folding unit 42. The foldable product can be acted upon from different sides by the blade in the cross-fold region by means of the blade folding units 42, 4, as described above.

As a result, the first blade folding unit 4 and the second blade folding unit 42 are configured in each case to generate a fold which runs in a second direction perpendicularly to the first direction. Generally, it is also within the scope of the invention to generate folds in the cross-fold region exclusively by the blade folding units, in particular by at least one first and at least one second blade folding unit 4, 42.

Optionally a press 78 can be provided downstream of each blade folding unit 4, 42 for compressing the product after the respective folding action.

Further blade folding units can follow the first blade folding unit 4, which in the exemplary embodiment shown can be configured corresponding to the second blade folding unit 42. The type, number and sequence of blade folding units can be adapted in any manner to the given requirements and the desired configuration of the folded product to be produced. It is thus possible for the person skilled in the art to adapt the folding machine 2 in the simplest possible manner in order to produce a plurality of different folded products.

It is also possible to provide in the cross-fold region one or more buckle folding units which implement a plurality of parallel folds in the second direction, which is perpendicular to the first direction in which the folds formed in the buckle folding unit 76 run. In any case, however, at least one blade folding unit 4 according to an aspect of the invention also has to be present in the cross-fold region.

Finally, at least one blade folding unit corresponding to the blade folding unit 4 or the blade folding unit 42 can also be used in addition to the buckle folding unit 76, in order to carry out at least one further folding action in the first direction parallel to the folding actions of the buckle folding unit 76 in FIG. 5.

The terms "first" and "second", etc. are thus not to be regarded as specifying a sequence in which the individually numbered components are arranged in the entire system. Rather, these terms are numbered according to the sequence of these components mentioned in the claims. It is thus possible, for example, that a claimed "second" component is located upstream of the claimed "first" component.

A preferred embodiment, as shown in FIG. 5, is the following sequence of the arrangement in the cross-fold region: second blade folding unit 42, first blade folding unit 4, second blade folding unit 42, second blade folding unit 42. The last second blade folding unit 42 can also be omitted if only three folding actions are to be carried out in the second direction. It is also possible to add a further second blade folding unit 42 so that a total of four blade folding units 4, 42 are arranged in the cross-fold region. Finally, it is conceivable that a further first blade folding unit 4 is used instead of a second blade folding unit 42.

Optionally, in all of the embodiments shown, a device 82 for quality control, for example with one or with two digital cameras which monitor the orientation of the product and the last folded edge and/or the thickness of the products, can be provided downstream of the last blade folding unit. If all of the aforementioned criteria are to be monitored, two cameras with inspection fields located perpendicularly to one another are required. In turn, a device 84 for ejecting faulty products, which can be controlled on the basis of the evaluation results of the device 82, can be provided following the device 82.

Optionally a stack formation unit 86 can also be provided for forming stacks of folded products.

During the production of folded products, one of the layouts of the folding machine described in the last three paragraphs can be used with particular advantage in order to produce folded products, in particular outserts, with at least 54, preferably at least 72, further preferably at least 90, further preferably at least 108 panels, further preferably at least 120 panels, up to 300 panels or even more. In this case, at least eight, preferably at least ten, further preferably at least twelve, folding actions are carried out in the first direction and at least three folding actions, preferably at least four folding actions, are carried out in the second direction.

Before the last folding action, during the production of the outserts, at least one adhesive point is applied to the product by means of a device 80 in order to hold the folded product in the closed state after the last folding action. Alternatively, an adhesive label can also be applied by the device 80, said adhesive label being folded around an edge of the folded product, after the last folding action, and in the end state being fastened to two opposing sides of the folded product in order to hold the folded product in the closed state. The device 80 can also be arranged downstream of the last folding unit.

The transfer of the products between the blade folding units 4, 42 is carried out in all of the embodiments, at least in some portions, by using conveying means as have been described above.

In all of the embodiments, the blade of the first blade folding unit 4 is preferably driven pneumatically.

The invention claimed is:

1. A folding machine comprising:

a buckle folding unit configured to fold a foldable product repeatedly in parallel in a first direction;

a first blade folding unit including a first and a second folding roller, wherein the first folding roller has a first folding roller axis and the second folding roller has a second folding roller axis which is arranged spaced apart and parallel to the first folding roller axis, so that the first and the second folding roller axes define a first folding roller plane which comprises both the first and the second folding roller axes;

a first folding blade which is oriented and is movable in a first folding blade plane, wherein the first folding blade plane is oriented perpendicularly to the first folding roller plane and intersects the first folding roller plane in a first intersection line, wherein the first folding blade is movable between a retracted position and an extended position, wherein the first folding blade is arranged in the extended position closer to the first folding roller plane than in the retracted position;

wherein the first folding blade is arranged in the retracted position in or below a horizontal plane which comprises the first intersection line;

a second blade folding unit including a third and a fourth folding roller, wherein the third folding roller has a third folding roller axis and the fourth folding roller has a fourth folding roller axis which is arranged spaced apart and parallel to the third folding roller axis, so that the third and the fourth folding roller axes define a second folding roller plane which comprises both the third and the fourth folding roller axis;

a second folding blade which is oriented and movable in a second folding blade plane, wherein the second folding blade plane is oriented perpendicularly to the second folding roller plane and intersects the second folding roller plane in a second intersection line, wherein the second folding blade is movable between a retracted position and an extended position, wherein the second folding blade is arranged in the extended position closer to the second folding roller plane than in the retracted position;

wherein the second folding blade is arranged in the retracted position above a horizontal plane which comprises the second intersection line;

wherein the first blade folding unit and the second blade folding unit are configured to fold the foldable product in a second direction perpendicularly to the first direction;

wherein the second blade folding unit is arranged such that the second blade folding unit undertakes a first folding action in the second direction, and the first blade folding unit is arranged downstream of the second blade folding unit to fold the foldable product once again in the second direction; and wherein a further second blade folding unit is arranged downstream of the first blade folding unit to fold the foldable product once again in the second direction.

2. The folding machine as claimed in claim 1, further comprising a first conveying device with an endless first conveying means and an endless second conveying means for conveying the foldable product to the first blade folding unit, wherein the first and the second conveying means run parallel to one another from an inlet region to an outlet region of the first conveying device, in order to receive the foldable product therebetween, wherein the first conveying means is configured to carry the foldable product at least in the inlet region and the second conveying means is configured to hold down the foldable product on the first conveying means at least in the inlet region, wherein the first and the second conveying means are arranged in the outlet region in each case substantially parallel to the first folding roller plane and perpendicularly to the folding roller axes, wherein the first folding blade is arranged in the retracted position closer to a portion of the first conveying means in the outlet region than to a portion of the second conveying means in the outlet region.

3. The folding machine as claimed in claim 2, wherein the second conveying means is arranged in the inlet region above the first conveying means.

4. The folding machine as claimed in claim 2, wherein the first conveying means is an endless band or an endless belt and the second conveying means is an endless band or an endless belt.

5. The folding machine as claimed in claim 2, wherein a plurality of first conveying means which run spaced apart and parallel to one another are present and/or wherein a plurality of second conveying means which run spaced apart and parallel to one another are present.

6. The folding machine as claimed in claim 1, wherein the first folding roller plane is oriented at an acute angle to the horizontal plane which comprises the first intersection line, and the first folding blade is arranged in the retracted position below the horizontal plane.

7. The folding machine as claimed in claim 6, wherein the acute angle is between 30° and 60°.

8. The folding machine as claimed in claim 1, further comprising a second conveying device with an endless third conveying means and an endless fourth conveying means for conveying products away from the first blade folding unit, wherein the third and the fourth conveying means run parallel to one another from an inlet region to an outlet region of the second conveying device in order to receive products therebetween, wherein the inlet region opposes the first folding blade relative to the folding roller plane.

9. The folding machine as claimed in claim 1, wherein the buckle folding unit is configured to fold the foldable product at least 8 times in parallel in the first direction.

10. The folding machine as claimed in claim 1, wherein in a cross-fold region in which folding actions are carried out in the second direction.

11. The folding machine as claimed in claim 10, wherein in the cross-fold region a total of exactly three, four or five blade folding units are arranged one after the other, exactly one or exactly two thereof being first blade folding units and the remaining blade folding units being second blade folding units.

12. The folding machine as claimed in claim 1, further comprising a device for applying an adhesive or an adhesive label to the folded product in order to hold the finished folded product in a closed state.

* * * * *